United States Patent [19]

Sass et al.

[11] 3,997,152

[45] Dec. 14, 1976

[54] CLAMPING ARRANGEMENT

[75] Inventors: Horst Werner Sass; Paul Francois Roos, both of Cape Town, South Africa

[73] Assignee: Trident Plastics (Proprietary) Limited, Tiervlei, South Africa

[22] Filed: Sept. 29, 1975

[21] Appl. No.: 617,657

[52] U.S. Cl. ..... 269/249; 269/286

[51] Int. Cl.[2] ..... B25B 1/10

[58] Field of Search ..... 269/286, 249

[56] References Cited

UNITED STATES PATENTS

| | | | |
|---|---|---|---|
| 1,412,961 | 4/1922 | Periolat | 269/249 |
| 2,852,463 | 9/1958 | Gutzmer | 269/286 |
| 3,259,563 | 7/1966 | Del Monica | 269/286 |

*Primary Examiner*—Al Lawrence Smith
*Assistant Examiner*—Robert C. Watson
*Attorney, Agent, or Firm*—Larson, Taylor and Hinds

[57] ABSTRACT

A clamp for holding a work piece in position in an anodizing bath which is constructed at least partially of material resistant to liquid contained in the anodizing bath.

The clamp is made completely of a synthetic plastic material which is resistant to liquid contained in the anodizing bath. The clamp comprises a U-shaped frame with a manually operable screw threadedly attached to a first leg of the frame. Titanium contact tips are provided, respectively, on the second leg and on the end of the screw.

2 Claims, 3 Drawing Figures

CLAMPING ARRANGEMENT

The present invention relates to clamping arrangements.

More particularly, the invention relates to clamping arrangements for use in special types of baths, such as anodising baths.

It must be understood that the invention is not limited to anodising baths, so that the expression "anodising baths" is to include all types of baths containing liquids, which attack normal metals.

In anodising baths electrodes or other elements have hitherto mostly been held in position by means of metal screws. A disadvantage was that the acid of the bath acted on the screws resulting in rapid deterioration and calling for early and frequent replacement. An improvement followed in the use of titanium bolts or clamps, which overcame the acid attack but had the disadvantage of high material costs. Another suggestion resided in the use of aluminium clamps, but these wore off rapidly.

It is an object of the invention to provide a clamping solution which will overcome the abovementioned disadvantages.

According to the invention there is provided a clamp for holding work piece in an anodizing bath, which clamp is made completely of a synthetic plastic material, which is resistant to liquid contained in the anodizing bath, the clamp comprising a U-shaped frame having two substantially parallel legs; a first contact tip made of titanium, fixed by being partially embedded in the material of the clamp adjacent the end of one leg of the U-shaped frame, the first contact tip facing towards the other leg; and a screw threaded hole adjacent the end of the other leg of the U-shaped frame and being in alignment with the first contact tip; a manually operable screw screwed into the threaded hole; and a second contact tip made of titanium and provided at the end of the screw facing the first contact tip and being fixed by being partially embedded in the end of the screw, the two contact tips being in alignment so as to clamp a work piece between them on turning of the screw to move the second contact tip towards the first contact tip.

The invention will now be described by way of example with reference to the accompanying schematic drawings.

Figure 1:
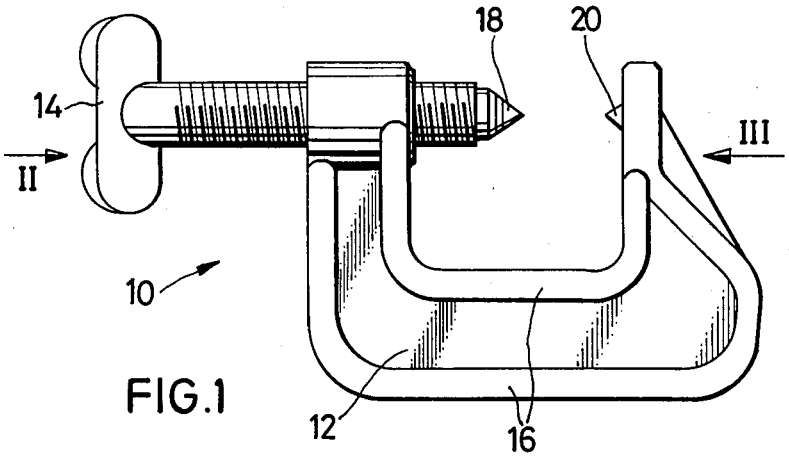
FIG. 1 shows a side view of a clamp in accordance with the invention.
Figure 2:
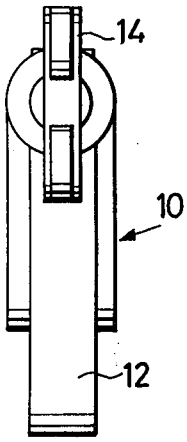
FIG. 2 shows an end view along arrow II in FIG. 1.
Figure 3:
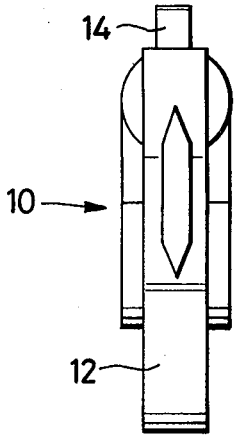
FIG. 3 shows an end view along arrow III in FIG. 1.

Referring to the drawings, the clamp, generally indicated by reference numeral 10, includes a U-shaped part 12 and a screw 14, both made of a thermoplastic material, e.g. polyphenylene oxide. The U-shaped part 12 is suitably reinforced, e.g. by reinforcement inserts (not shown) and by ridges 16.

The screw 14 has a cone-shaped tip 18, made of titanium. It co-operates with a similar tip 20, embedded in the outer leg of the U-shaped part 12, and also made of titanium.

In use, a work piece is clamped between the tips 18 and 20, and is then inserted into an anodising bath for treatment. The fluid of the bath cannot attack the screw 14 and the part 12, because of the material of which these parts are made of. Also the fluid does not attack the titanium tips 18 and 20. A clamp with an increased useful life is thus provided.

We claim:

1. A clamp for holding a work piece in position in an anodizing bath, which clamp is made completely of a synthetic plastic material, which is resistant to liquid contained in the anodizing bath, the clamp comprising a U-shaped frame having two substantially parallel legs; a first contact tip made of titanium fixed by being partially embedded in the material of the clamp adjacent the end of one leg of the U-shaped frame, the first contact tip facing towards the other leg; a screw-threaded hole adjacent the end of the other leg of the U-shaped frame and being in alignment with the first contact tip; a manually operable screw screwed into the threaded hole; and a second contact tip made of titanium and provided at the end of the screw facing the first contact tip and being fixed by being partially embedded in the end of the screw, the two contact tips being in alignment so as to clamp a work piece between them on turning of the screw to move the second contact tip towards the first contact tip.

2. A clamp as claimed in claim 1, which is suitably reinforced by reinforcement ridges.

* * * * *